US010290934B2

(12) United States Patent
Tomonari et al.

(10) Patent No.: US 10,290,934 B2
(45) Date of Patent: May 14, 2019

(54) ANTENNA DEVICE

(71) Applicant: TDK CORPORATION, Tokyo (JP)

(72) Inventors: Toshio Tomonari, Tokyo (JP); Hirohumi Asou, Tokyo (JP); Toshifumi Komachi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 267 days.

(21) Appl. No.: 14/696,768

(22) Filed: Apr. 27, 2015

(65) Prior Publication Data

US 2015/0318609 A1 Nov. 5, 2015

(30) Foreign Application Priority Data

Apr. 30, 2014 (JP) ..... 2014-093529
Apr. 30, 2014 (JP) ..... 2014-093531

(51) Int. Cl.

| | |
|---|---|
| ***H01Q 7/00*** | (2006.01) |
| ***H01Q 1/38*** | (2006.01) |
| ***H01Q 1/52*** | (2006.01) |
| ***H01Q 7/06*** | (2006.01) |
| ***H01Q 1/24*** | (2006.01) |

(52) U.S. Cl.

CPC ..... *H01Q 1/38* (2013.01); *H01Q 1/243* (2013.01); *H01Q 1/52* (2013.01); *H01Q 1/526* (2013.01); *H01Q 7/00* (2013.01); *H01Q 7/06* (2013.01)

(58) Field of Classification Search

CPC ..... H01Q 1/38; H01Q 1/243; H01Q 1/52; H01Q 1/526; H01Q 7/00; H01Q 7/06

See application file for complete search history.

(56) References Cited

U.S. PATENT DOCUMENTS

| | | | | |
|---|---|---|---|---|
| 2002/0053992 | A1 | 5/2002 | Kawakami et al. | |
| 2006/0267854 | A1 | 11/2006 | Naito | |
| 2009/0201116 | A1* | 8/2009 | Orihara | G06K 19/07749 336/200 |
| 2012/0262357 | A1 | 10/2012 | Kato | |
| 2012/0306714 | A1 | 12/2012 | Yosui et al. | |
| 2014/0198006 | A1* | 7/2014 | Nakano | G06K 19/07794 343/788 |
| 2015/0214620 | A1* | 7/2015 | Yosui | H01Q 7/00 343/702 |

FOREIGN PATENT DOCUMENTS

| | | |
|---|---|---|
| CN | 203481368 U | 3/2014 |
| JP | 2002-111363 | 4/2002 |

(Continued)

*Primary Examiner* — Jessica Han
*Assistant Examiner* — Jae K Kim
(74) *Attorney, Agent, or Firm* — Young Law Firm, P.C.

(57) ABSTRACT

An antenna device is provided with a substrate; an antenna coil formed into a loop-shaped or spiral-shaped on the substrate; a first metallic layer overlapping with a first part of the antenna coil in a planar view; and a second metallic layer overlapping with a second part of the antenna coil different from the first part. The first and second metallic layers are disposed on both sides of a center of an inner diameter portion of the antenna coil in a planar view, respectively. A slit formed between the first and second metallic layers overlaps with the inner diameter portion of the antenna coil in a planar view. At least one of the first and second metallic layers is formed on the substrate together with the antenna coil.

20 Claims, 16 Drawing Sheets

(56) References Cited

FOREIGN PATENT DOCUMENTS

| | | | | |
|---|---|---|---|---|
| JP | 2007324865 | | 12/2007 | |
| JP | 4687832 | | 10/2010 | |
| JP | 2012-060372 | A | 3/2012 | |
| JP | 2013-162195 | | 8/2013 | |
| JP | WO 2013115017 | A1 * | 8/2013 | ..... G06K 19/07794 |
| JP | 2014049873 | A | 3/2014 | |
| JP | WO 2014125927 | A1 * | 8/2014 | ..... H01Q 7/00 |
| KR | 2006-0125539 | | 12/2006 | |

* cited by examiner

ANTENNA DEVICE

BACKGROUND OF THE INVENTION

Field of the Invention

The present invention relates to an antenna device and, more particularly, to an antenna device suitable for NFC (Near Field Communication).

Description of Related Art

In recent years, a mobile electronic device such as a smartphone is equipped with an RFID (Radio Frequency Identification: individual identification by radio waves) system and further equipped with, as a communication means of the RFID, an antenna for performing near field communication with a reader/writer and the like.

Further, the mobile electronic device is provided with a metallic shield so as to protect a built-in circuit from external noise and to prevent unnecessary radiation of noise generated inside the device. Particularly, recently, a housing itself of the mobile electronic device is made of metal instead of resin, considering thinness, light weight, durability against drop impact, design, and the like. Cases where the metallic housing doubles as the metallic shield have been increasing. However, since generally the metallic shield shields electric waves, when an antenna needs to be provided, it is necessary to arrange the antenna at a position not overlapping with the metallic shield. When the metallic shield is arranged over a wide range, arrangement of the antenna becomes a serious problem.

To solve the above problem, in antenna devices disclosed in, e.g., Japanese Patent No. 4,687,832, Japanese Patent Application Laid-Open No. 2002-111363, and Japanese Patent Application Laid-Open No. 2013-162195, an opening is formed in a conductive layer, a slit connecting the opening and an outer edge is formed, and an antenna coil is arranged such that an inner diameter portion thereof overlaps with the opening. In this configuration, current flows in the conductive layer so as to shield a magnetic field generated by flowing of current in a coil conductor, and the current flowing around the opening of the conductive layer passes around the slit, with the result that current flows also around the conductive layer by edge effect. As a result, a magnetic field is generated also from the conductive layer, and the conductive layer makes a large loop of a magnetic flux, thereby increasing a communication distance between the antenna device and an antenna of an apparatus at a communication partner side. That is, it is possible to allow the conductive layer to function as an accelerator for increasing a communication distance of the antenna coil.

However, in the above conventional antenna device, it is necessary to form the opening and slit in the conductive layer, which imposes restrictions on freedom of layout of the antenna coil. For example, if the opening cannot be formed at a desired position due to design restrictions, or if formation of the slit is not allowed even though the opening can be formed, the antenna device cannot be constructed. The same problem occurs when an opening for exposing a lens of a camera module cannot be used as the opening for the antenna coil.

SUMMARY

Therefore, an object of the present invention is to provide an antenna device capable of increasing a communication distance of the antenna coil even when the opening or slit is not formed in the conductive layer provided on a mobile electronic apparatus side. Another object of the present invention is to provide a small-type antenna device capable of facilitating frequency matching.

To solve the above problem, an antenna device according to a first aspect of the present invention includes a substrate, an antenna coil formed into loop-shaped or spiral-shaped on the substrate, a first metallic layer overlapping with a first part of the antenna coil in a planar view, and a second metallic layer overlapping with a second part of the antenna coil different from the first part, wherein the first and second metallic layers are disposed on both sides of a center of an inner diameter portion of the antenna coil in a planar view, respectively, a slit formed between the first and second metallic layers overlaps with the inner diameter portion of the antenna coil in a planar view, and at least one of the first and second metallic layers is formed on the substrate together with the antenna coil.

According to the present invention, at least one of the first and second metallic layers is formed on the substrate together with the antenna coil, and the slit formed between the first and second metallic layers overlaps with the inner diameter portion of the antenna coil, so that even when an opening or a slit is not formed in a conductive layer provided on a mobile electronic apparatus side, it is possible to increase a communication distance of the antenna coil. Particularly, a dedicated support substrate or an adhesive layer is not interposed between each of the first and second metallic layers and the antenna coil, so that it is possible to bring the first and second metallic layers 12A and 12B and the antenna coil close to each other. This strengthens magnetic coupling between a magnetic flux generated by the antenna coil and the metallic layers, thereby increasing a communication distance of the antenna. This further eliminates a process of bonding the first and second metallic layers to the antenna coil, which is required when the first and second metallic layers are formed on a substrate different from a substrate on which the antenna coil is formed, thereby simplifying a production process of the antenna device.

In the present invention, it is preferable that both of the first and second metallic layers are formed on the substrate together with the antenna coil. With this configuration, it is possible to bring the antenna coil close to both of the first and second metallic layers, thereby reliably increasing a communication distance of the antenna.

In the present invention, it is preferable that the first metallic layer is formed on the substrate together with the antenna coil and that the second metallic layer is a member that constitutes a housing in which the antenna device is housed. With this configuration, it is possible to form the second metallic layer by utilizing a housing side metallic body, thereby reducing material cost and increasing efficiency of component layout.

In the present invention, it is preferable that the antenna coil includes a combination of a first pattern formed on one main surface of the substrate and a second pattern formed on the other main surface of the substrate, that the first metallic layer is formed on the other main surface of the substrate, that the second metallic layer is provided so as to be opposed to the other main surface of the substrate, and that the second pattern is provided so as to overlap with the second metallic layer in a planar view. With this configuration, positions of the second pattern and the first metallic layer which are formed on the other main surface of the substrate do not overlap with each other, thereby efficiently laying out the antenna coil and the first metallic layer on the substrate.

In the present invention, it is preferable that the antenna device further includes a metallic body provided so as to overlap with the antenna coil in a planar view and a magnetic sheet provided between the antenna coil and the metallic body. With this configuration, it is possible to ensure a magnetic path of a magnetic loop that interlinks with the antenna coil, thereby reducing influence of the metallic body.

In the present invention, it is preferable that the antenna device further includes a center metallic layer provided in a center portion of the inner diameter portion of the antenna coil in a planar view. With this configuration, two slits can be provided between the first and second metallic layers, thereby increasing a communication distance of the antenna coil as compared to a case where a single slit is provided.

In the present invention, it is preferable that the antenna device further includes a third metallic layer that overlaps with a third part of the antenna coil different from the first and second parts in a planar view, and a fourth metallic layer that overlaps with a fourth part of the antenna coil different from the first to third parts in a planar view, wherein the third and fourth metallic layers are disposed on both sides of the center of the inner diameter portion of the antenna coil in a planar view, respectively. In this configuration, a magnetic flux penetrating the inner diameter portion of the antenna coil passes through an area surrounded by each of the first to fourth metallic layers, so that a path of the magnetic flux can be concentrated on the inner diameter portion, thereby increasing a communication distance of the antenna. Further, by additionally providing the third and fourth metallic layers each having a relatively smaller size, it is possible to increase a loop size of the magnetic flux while reducing a loss of the magnetic flux that interlinks with the antenna coil, thereby increasing a communication distance further effectively.

To solve the above problem, an antenna device according to a second aspect of the present invention includes a substrate, an antenna coil formed into a loop-shaped or spiral-shaped on the substrate, a first metallic layer overlapping with a first part of the antenna coil in a planar view, a second metallic layer overlapping with a second part of the antenna coil different from the first part in a planar view, wherein a planar size of the second metallic layer is larger than a planar size of the first metallic layer.

According to the present invention, the first and second metallic layers that partially cover the antenna coil strengthen a magnetic flux interlinking with the antenna coil, so that even when an opening or a slit is not formed in a conductive layer provided on a mobile electronic apparatus side, it is possible to increase a communication distance of the antenna coil. Particularly, since the planar size of the first metallic layer is relatively small, and the planar size of the second metallic layer is relatively large, it is possible to reduce a loss of the magnetic flux that interlinks with the antenna coil, thereby increasing a communication distance effectively. In addition, a floating capacitance between the antenna coil and the first metallic layer can be reduced to facilitate antenna frequency matching.

In the present invention, it is preferable that the first metallic layer is formed on the substrate together with the antenna coil and that the second metallic layer is a member that constitutes a housing in which the antenna device is housed. With this configuration, it is possible to efficiently lay out the first metallic layer and to form the second metallic layer by utilizing a housing side metallic body, thereby reducing material cost and increasing efficiency of component layout.

In the present invention, it is preferable that the antenna coil includes a combination of a first pattern formed on one main surface of the substrate and a second pattern formed on the other main surface of the substrate, that the first metallic layer is formed on the other main surface of the substrate, that the second metallic layer is provided so as to be opposed to the other main surface of the substrate, and that the second pattern is provided so as to overlap with the second metallic layer in a planar view. With this configuration, it is possible to efficiently lay out the antenna coil and the first and second metallic layers on the substrate.

In the present invention, the first and second metallic layers are preferably disposed on both sides of a center of an inner diameter portion of the antenna coil in a planar view, respectively. In this configuration, a magnetic flux penetrating the inner diameter portion of the antenna coil passes through a slit formed between the first and second metallic layers, so that a path of the magnetic flux can be concentrated on the inner diameter portion. This strengthens the magnetic flux of the antenna coil, thereby increasing a communication distance of the antenna.

In the present invention, it is preferable that the first metallic layer is provided on one end side of the substrate in a first width direction of the substrate, and that the second metallic layer is provided on the other end side of the substrate in the first width direction of the substrate. In this case, it is preferable that a width of the first metallic layer in a second width direction perpendicular to the first width direction is equal to or less than a width of the inner diameter portion of the antenna coil in the second width direction, and that a width of the second metallic layer in the second width direction is larger than a width of the substrate in the second width direction. By reducing the width of the first metallic layer to be formed on the substrate so as to allow the magnetic flux to easily pass through the inner diameter portion of the antenna coil, it is possible to reduce a loss of the magnetic flux, thereby increasing a communication distance. In addition, a floating capacitance between the antenna coil and the first metallic layer can be reduced to facilitate antenna frequency matching. Further, a loop size of the magnetic flux can be increased by the second metallic layer, thereby contributing to an increase in a communication distance.

In the present invention, it is preferable that the antenna device further includes a metallic body provided so as to overlap with the antenna coil in a planar view and a magnetic sheet provided between the antenna coil and the metallic body. With this configuration, it is possible to ensure a magnetic path of a magnetic loop that interlinks with the antenna coil, thereby reducing influence of the metallic body.

In the present invention, it is preferable that the antenna device further includes a center metallic layer provided in a center portion of the inner diameter portion of the antenna coil. With this configuration, two slits can be provided between the first and second metallic layers, thereby increasing a communication distance of the antenna coil as compared to a case where a single slit is provided.

In the present invention, it is preferable that the antenna device further includes a third metallic layer that overlaps with a third part of the antenna coil different from the first and second parts in a planar view, and a fourth metallic layer that overlaps with a fourth part of the antenna coil different from the first to third parts in a planar view, wherein the third and fourth metallic layers are disposed on both sides of the center of the inner diameter portion of the antenna coil in a planar view, respectively. In this case, the third and fourth metallic layers are preferably formed on the substrate together with the antenna coil and the first metallic layer.

Further, it is preferable that the third metallic layer is provided on one end side of the substrate in the second width direction of the substrate, and that the fourth metallic layer is provided on the other end side of the substrate in the second width direction of the substrate. In this configuration, a magnetic flux penetrating the inner diameter portion of the antenna coil passes through an area surrounded by the first to fourth metallic layers, so that a path of the magnetic flux can be concentrated on the inner diameter portion. This increases a communication distance of the antenna. Further, by additionally providing the third and fourth metallic layers each having a relatively small size, it is possible to increase a loop size of the magnetic flux while reducing a loss of the magnetic flux that interlinks with the antenna coil, thereby increasing a communication distance further effectively.

According to the present invention, a small antenna device capable of increasing a communication distance of the antenna coil and facilitating frequency matching can be provided.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1A:
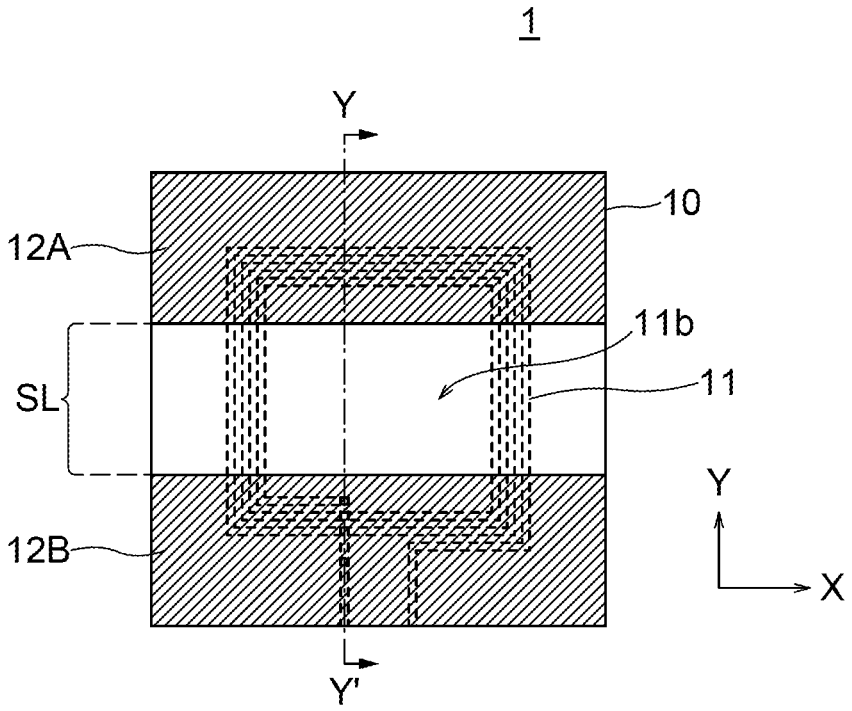
FIG. 1A is a plan view illustrating a configuration of an antenna device according to a first embodiment of the present invention.
Figure 1B:
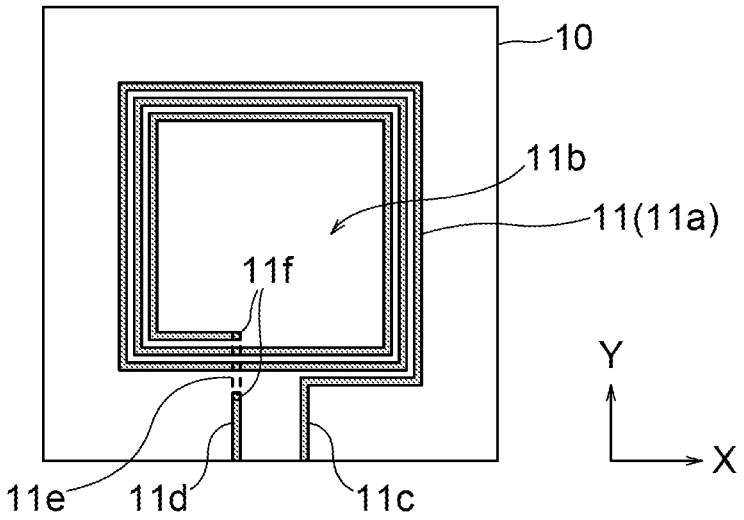
FIG. 1B is a transparent view of the antenna coil when viewed from the same direction as FIG. 1A.
Figure 2:
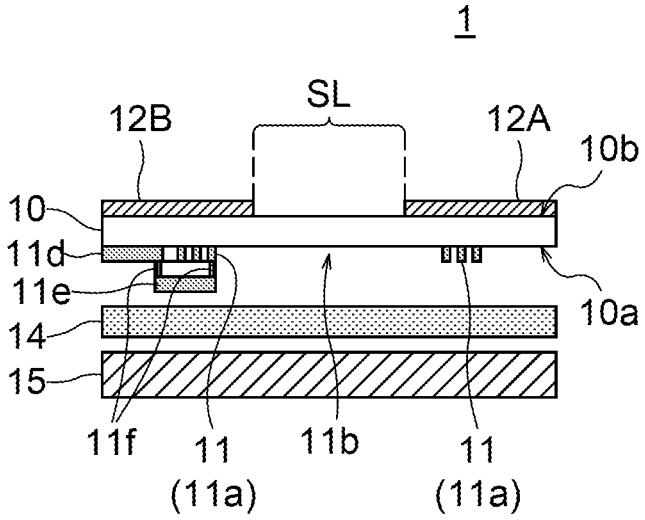
FIG. 2 is a cross-sectional view of the antenna device taken along a line Y-Y' of FIG. 1A.

FIGS. 1A and 1B are plan views each illustrating a configuration of an antenna device according to a first embodiment of the present invention. Particularly, FIG. 1B is a view transparently illustrating the antenna coil when viewed from the same direction as FIG. 1A. FIG. 2 is a cross-sectional view of the antenna device taken along a line Y-Y' of FIG. 1A.

As illustrated in FIGS. 1A and 1B and FIG. 2, an antenna device 1 includes a substrate 10, a spiral antenna coil 11 formed on the substrate 10, first and second metallic layers 12A and 12B provided so as to overlap with the antenna coil 11 in a planar view, and a magnetic sheet 14 provided on a side opposite to the first and second metallic layers 12A and 12B with respect to the antenna coil 11.

The substrate 10 is, e.g., a flexible substrate made of PET resin and has a planar size of 40 mm×50 mm and a thickness of about 30 μm. The antenna coil 11 has a substantially rectangular spiral pattern 11*a* and is formed mainly on one main surface 10*a* (lower surface) of the substrate 10. The antenna coil 11 may be formed by plating or by etching (patterning) of a metallic layer previously formed on the entire surface of the substrate 10.

Both ends of the spiral pattern 11*a* of the antenna coil 11 are led to an edge of the substrate 10 by lead sections 11*c* and 11*d*. Particularly, an inner peripheral end of the spiral pattern 11*a* is led outside a loop through a bridge section 11*e* crossing the loop. The both ends of the antenna coil 11 are connected to, e.g., a main circuit substrate. The connection method is not especially limited. For example, the lead sections 11*c* and 11*d* may be extended together with the substrate 10 made of a flexible material so as to be connected to the main circuit substrate. Alternatively, a power feed pin may be used for the connection.

In the present embodiment, the bridge section 11*e* is formed on the spiral pattern 11*a* formed on one main surface 10*a* of the substrate 10 through an insulating film such as a PET film. In this case, a double-layer structure of a metal film is partially formed on the one main surface 10*a* side of the substrate 10. One end and the other end of the bridge section 11*e* are connected, respectively, to the inner peripheral end of the spiral pattern 11*a* and one end of the lead section 11*d* through through-hole conductors 11*f* and 11*f* penetrating the insulating film. The antenna coil 11 is formed by only a pattern formed on the one main surface 10*a* of the substrate 10, so that it is possible to use the entire surface of the other main surface 10*b* of the substrate as a formation area of first and second metallic layers 12A and 12B.

In the present embodiment, the first and second metallic layers 12A and 12B are each have a so-called solid pattern and formed on the other main surface 10*b* (upper surface) of the substrate 10. The first and second metallic layers 12A and 12B may be formed by plating or by etching of a metallic layer previously formed on the entire surface of the substrate 10. When the plating is adopted, the first and second metallic layers 12A and 12B can be formed simultaneously with formation of the antenna coil 11. When the etching of the metallic layer is adopted, the first and second metallic layers 12A and 12B each having a thickness different from a thickness of the antenna coil 11 can be formed. In either case, the first and second metallic layers 12A and 12B are not bonded to the substrate surface, and thus no adhesive (adhesive layer) is interposed, so that it is possible to bring the first and second metallic layers 12A and 12B close to the antenna coil 11, thereby strengthening magnetic coupling between them, which results in an increase in a communication distance.

A metallic body 15 is provided at a position more distant than the magnetic sheet 14 from the antenna coil 11. The metallic body 15 is, e.g., a battery case of a mobile electronic device such as a smartphone in which the antenna device 1 is mounted. By interposing the magnetic sheet 14 between the antenna coil 11 and the metallic body 15, it is possible to reduce influence that the metallic body 15 exerts on the antenna coil 11, thereby increasing inductance, which can improve antenna characteristics.

The first metallic layer 12A is provided on one end side in a Y-direction (first width direction) of the substrate 10, and the second metallic layer 12B is provided on the other end side in the Y-direction of the substrate 10. The first and second metallic layers 12A and 12B are disposed on both sides of a center of an inner diameter portion 11*b* of the antenna coil 11 in a planar view.

A slit SL having a constant width is provided between the first and second metallic layers 12A and 12B, and the first and second metallic layers 12A and 12B are electrically isolated by the slit SL. A width of the slit SL is preferably smaller than a width of the inner diameter portion 11*b* of the antenna coil 11 in the same direction (Y direction). The slit SL is provided at a center of the substrate 10 in a width direction thereof so as to cross the inner diameter portion 11*b* of the antenna coil 11. That is, the antenna coil 11 is laid out such that the inner diameter pattern 11*b* thereof overlaps with the slit SL in a planar view. A part of the antenna coil 11 that extends parallel to the slit SL preferably overlaps with the first and second metallic layers 12A or 12B in a planar view.

Figure 3:
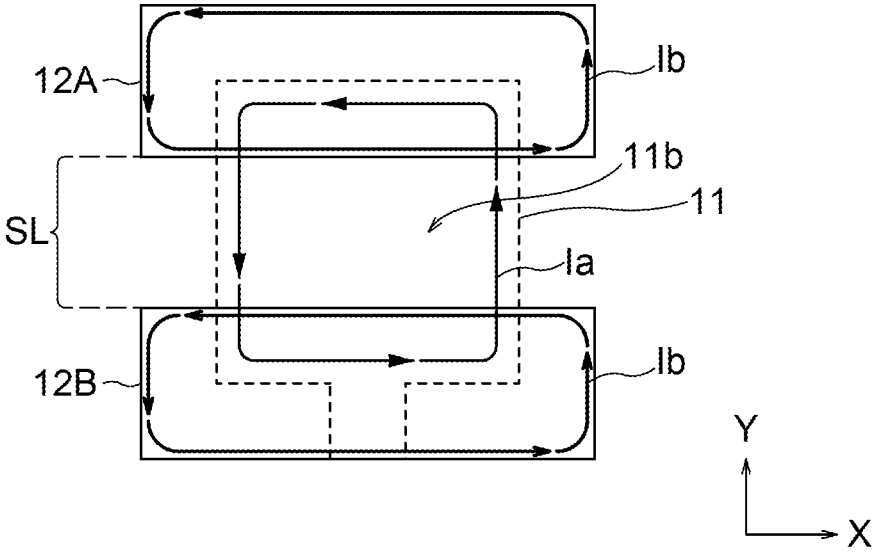
FIG. 3 is a plan view for explaining action of first and second metallic layers to the antenna coil.
Figure 4:
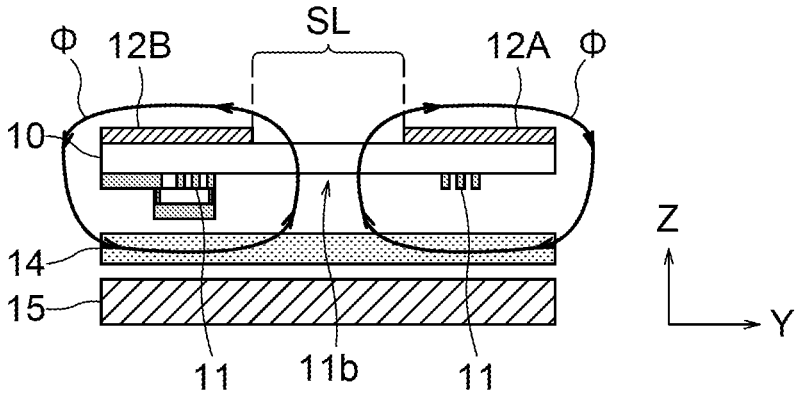
FIG. 4 is a cross-sectional view for explaining action of the first and second metallic layers to the antenna coil.

FIGS. 3 and 4 are views for explaining action of the first and second metallic layers 12A and 12B to the antenna coil 11. FIG. 3 is a plan view and FIG. 4 is a cross-sectional view.

As illustrated in FIGS. 3 and 4, when a counterclockwise current Ia flows in the antenna coil 11, the magnetic flux ϕ to penetrate the inner diameter pattern 11*b* of the antenna coil 11 is generated. This magnetic flux ϕ passes through the slit SL disposed between the first and second metallic layers 12A and 12B and interlinks with the first and second metallic layers 12A and 12B. On the other hand, current generated by a magnetic flux in a direction that cancels the magnetic flux ϕ flows in the first and second metallic layers 12A and 12B. This current becomes an eddy current Ib by edge effect and flows along outer peripheries of the first and second metallic layers 12A and 12B. The eddy current Ib flows in the counterclockwise direction like the current Ia flowing in the antenna coil 11.

The magnetic flux ϕ that has passed through the slit SL tends to go by roundabout routes each of which makes the slit SL disposed between the first and second metallic layers 12A and 12B the inside and makes an outer edge of each of the first and second metallic layers 12A and 12B the outside. As a result, the magnetic flux ϕ interlinks with an antenna coil of a reader/writer while depicting a relatively large loop, with the result that the antenna device 1 is magnetically coupled to an antenna of an apparatus at a communication partner side. Particularly, since a planar size of an outer periphery of the entire metallic layer including the first and second metallic layers 12A and 12B and slit SL is larger than a planar size of the antenna coil 11, a large loop magnetic field can be generated. Further, the magnetic sheet 14 is provided on a side opposite to the first and second metallic layers 12A and 12B with respect to the antenna coil 11, so that it is possible to increase inductance while ensuring magnetic path of the magnetic flux ϕ, thereby improving antenna characteristics.

As described above, in the antenna device 1 according to the present embodiment, the first and second metallic layers 12A and 12B make the loop of the magnetic flux ϕ of the antenna coil 11 widely circulate, thereby increasing a communication distance of the antenna device 1. Further, the first and second metallic layers 12A and 12B each are formed directly on the substrate 10, i.e., no adhesive layer is interposed between the substrate 10 and each of the first and second metallic layers 12A and 12B, so that it is possible to bring the antenna coil 11 and the first and second metallic layers 12A and 12B close to each other, thereby strengthening magnetic coupling between them, which results in a reliable increase in a communication distance.

Figure 5:
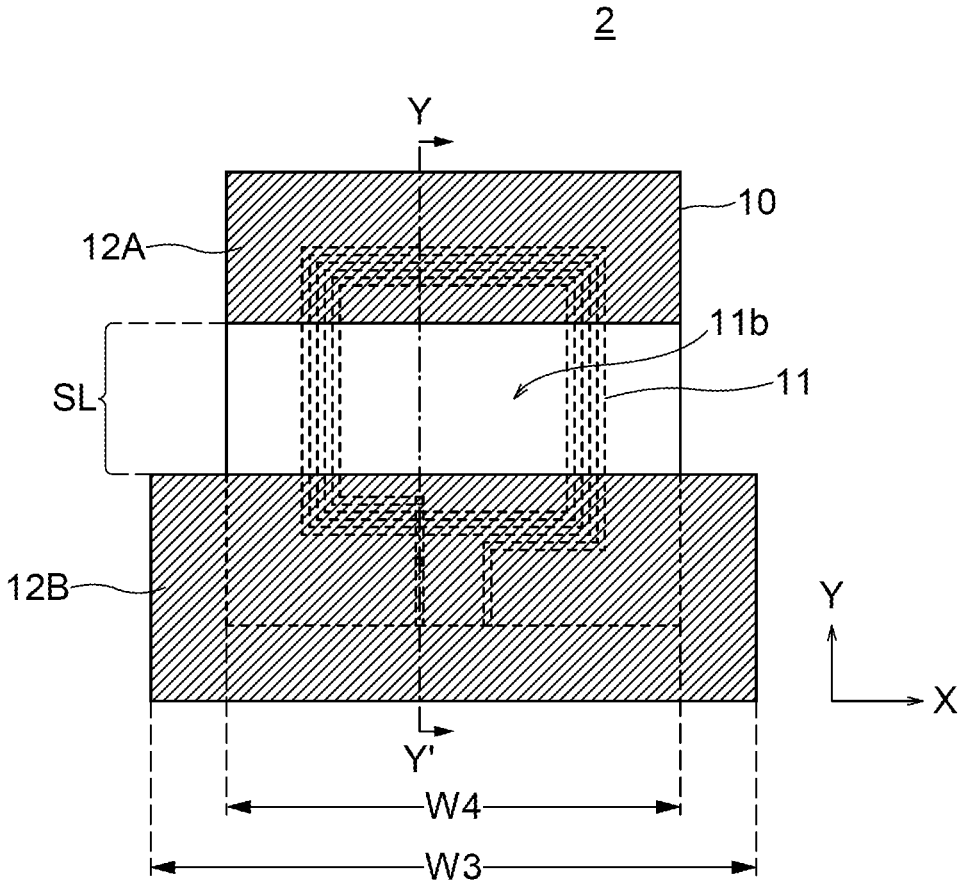
FIG. 5 is a plan view illustrating a configuration of an antenna device according to a second embodiment of the present invention.
Figure 6:
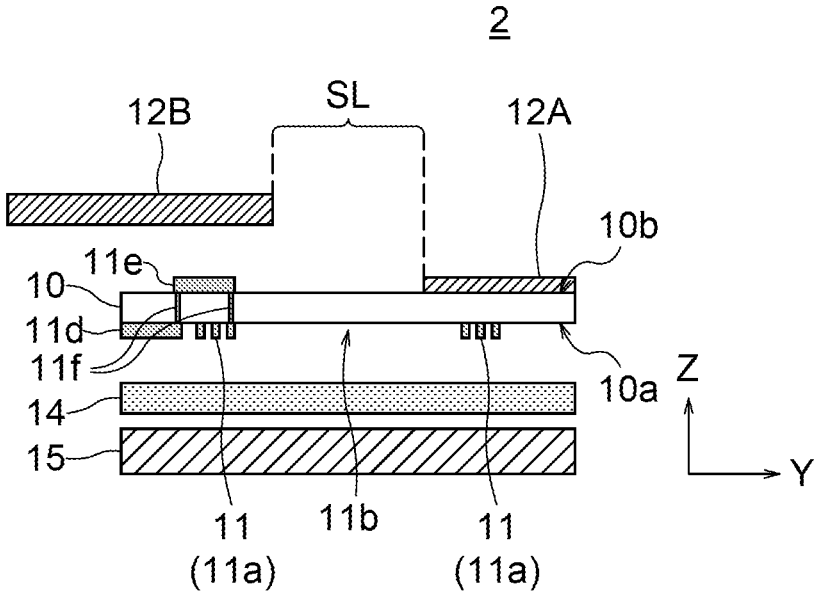
FIG. 6 is a cross-sectional view illustrating the configuration of the antenna device according to the second embodiment of the present invention.

FIGS. 5 and 6 are views each illustrating a configuration of the antenna device according to a second embodiment of the present invention. FIG. 5 is a plan view and FIG. 6 is a cross-sectional view.

As illustrated in FIGS. 5 and 6, an antenna device 2 of the second embodiment is characterized in that only the first metallic layer 12A is formed on the substrate 10, while the second metallic layer 12B is formed separately from the substrate 10. Specifically, the second metallic layer 12B is provided above the other main surface 10*b* of the substrate 10 so as to be opposite to the other main surface 10*b*. The second metallic layer 12B is preferably a member that constitutes a housing of a mobile electronic device, such as a smartphone, in which the antenna device is housed. The second metallic layer 12B may be formed on a support substrate which is different from the housing. A width W3 of the second metallic layer 12B in an X-direction is larger than a width W4 of the substrate 10 in the X-direction.

In the present embodiment, the bridge section 11*e* for drawing the inner peripheral end of the antenna coil 11 outside the loop is formed on the other main surface 10*b* of the substrate 10. The one end and the other end of the bridge section 11*e* are connected, respectively, to the inner peripheral end of the spiral pattern 11*a* and one end of the lead section 11*d* through through-hole conductors 11*f* and 11*f*. The antenna coil 11 is formed by only patterns formed directly on the one and the other main surfaces 10*a* and 10*b* of the substrate 10, so that it is not necessary to laminate additional metallic layer for formation of the bridge section 11*e*, thus facilitating formation of the bridge section 11*e*. Particularly, since the second metallic layer 12B is not formed on the substrate 10, the bridge section 11*e* can be provided at a position overlapping with the second metallic layer 12B in a planar view, thus providing easy layout of the bridge section 11*e*.

As described above, the antenna coil 11 is formed by a combination of a first pattern (including the spiral pattern 11*a* and the lead sections 11*c* and 11*d*) formed on the one main surface 10*a* of the substrate and a second pattern (including the bridge section 11*e*) formed on the other main surface 10*b*, and the bridge section 11*e* is formed so as to overlap with the second metallic layer 12B in a planar view.

With this configuration, the antenna coil 11 and the first and second metallic layers 12A and 12B can be effectively laid out.

In the present embodiment, the slit SL is formed by a combination of the first metallic layer 12A on the substrate 10 side and the second metallic layer 12B on the housing side and thereby constitute an accelerator for the antenna coil 11, so that the same effects as those obtained in the first embodiment can be obtained. Further, using the metallic body eliminates the need to prepare a dedicated metallic layer, thereby reducing material cost and increasing efficiency of component layout. Further, by making use of the size of the second metallic layer 12B, the loop size of the magnetic flux can be increased, thereby contributing to an increase in a communication distance.

Figure 7:
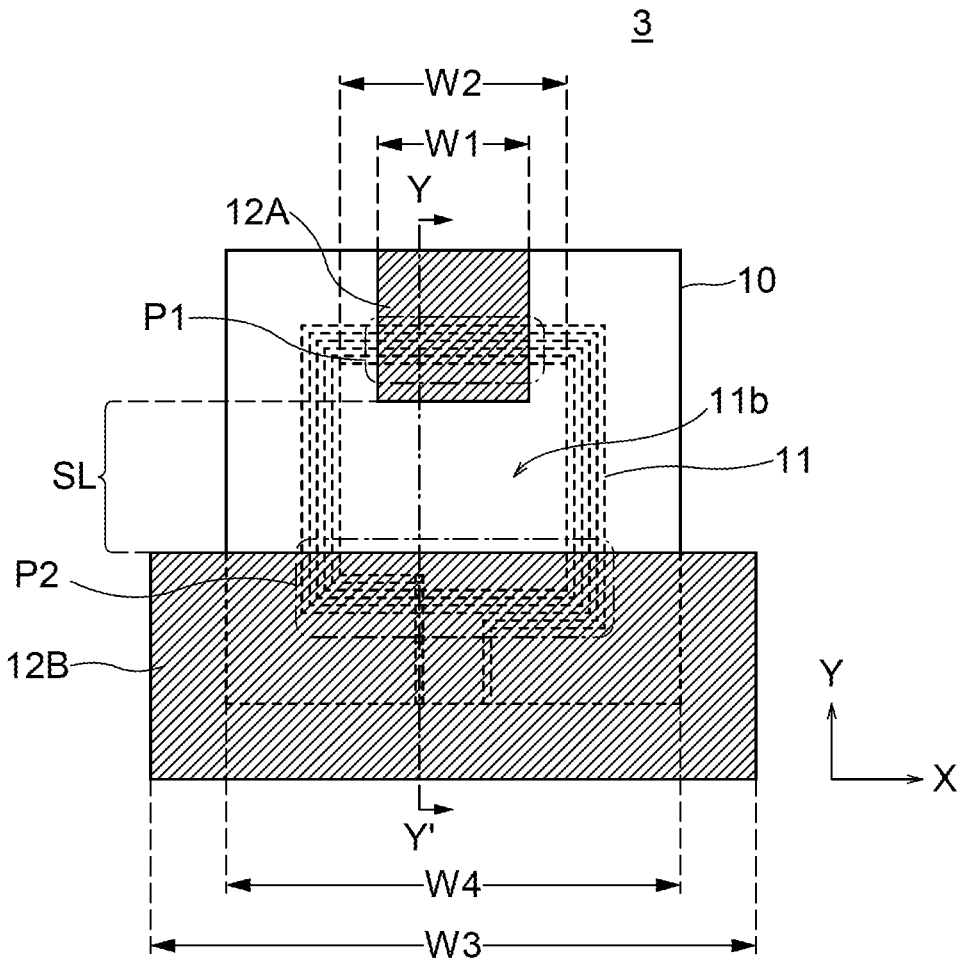
FIG. 7 is a plan view illustrating a configuration of an antenna device according to a third embodiment of the present invention.

FIG. 7 is a plan view illustrating a configuration of the antenna device according to a third embodiment of the present invention.

As illustrated in FIG. 7, an antenna device 3 of the third embodiment is a modification of the second embodiment and is characterized in that a width W1 of the first metallic layer 12A in the X-direction (second direction) is smaller than the width W4 of the substrate 10 in the X-direction and is, particularly, set to equal to or less than a width W2 of the inner diameter pattern 11*b* of the antenna coil 11 in the X-direction. Thus, a planar size of the first metallic layer 12A is smaller than that of the second metallic layer 12B. Other configurations are the same as those of the first embodiment.

The first metallic layer 12A overlaps with a first part P1 of the antenna coil 11 in a planar view. The second metallic layer 12B overlaps with a second part P2 of the antenna coil 11 that is opposed to the first part P1 across the inner diameter portion 11*b* of the antenna coil 11 in a planar view. An area of the first part P1 of the antenna coil 11 covered by the first metallic layer 12A is smaller than an area of the second part P2 of the antenna coil 11 covered by the second metallic layer 12B.

As described above, when the width W1 of the first metallic layer 12A is equal to or less than the width W2 of the inner diameter pattern 11*b* of the antenna coil, the coil pattern does not overlap with the metallic layer more than necessary, so that a loss of the magnetic flux can be reduced, thereby increasing a communication distance. Further, a reduction in the planar size of the first metallic layer 12A allows a reduction in size of the substrate 10, thereby increasing a degree of freedom of layout in the mobile electronic apparatus. Further, the reduction in the planar size of the first metallic layer 12A can lead to a reduction in a floating capacitance between the first metallic layer 12A and the antenna coil 11, thereby facilitating the antenna frequency matching. Although the planar size of the first metallic layer 12A is small, the planar size of the second metallic layer 12B is large, so that the loop size of the magnetic field can be increased by the second metallic layer 12B.

Figure 8:
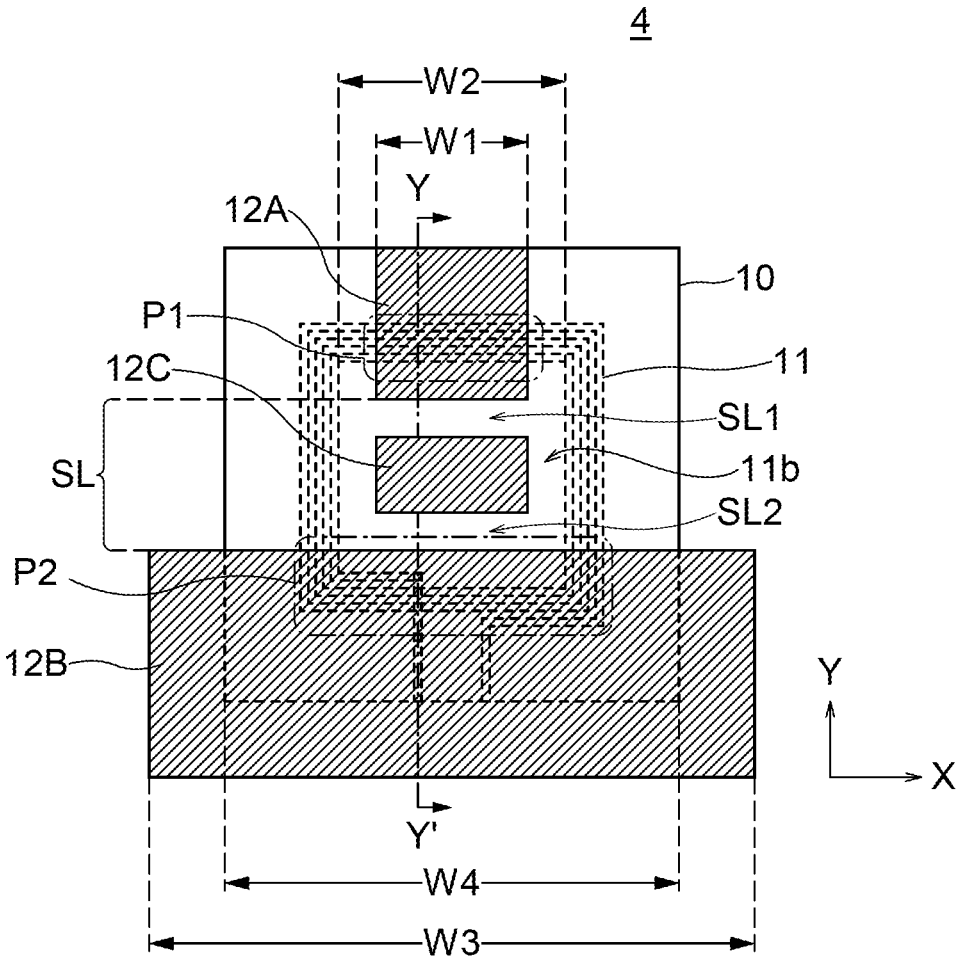
FIG. 8 is a plan view illustrating a configuration of an antenna device according to a fourth embodiment of the present invention.
Figure 9:
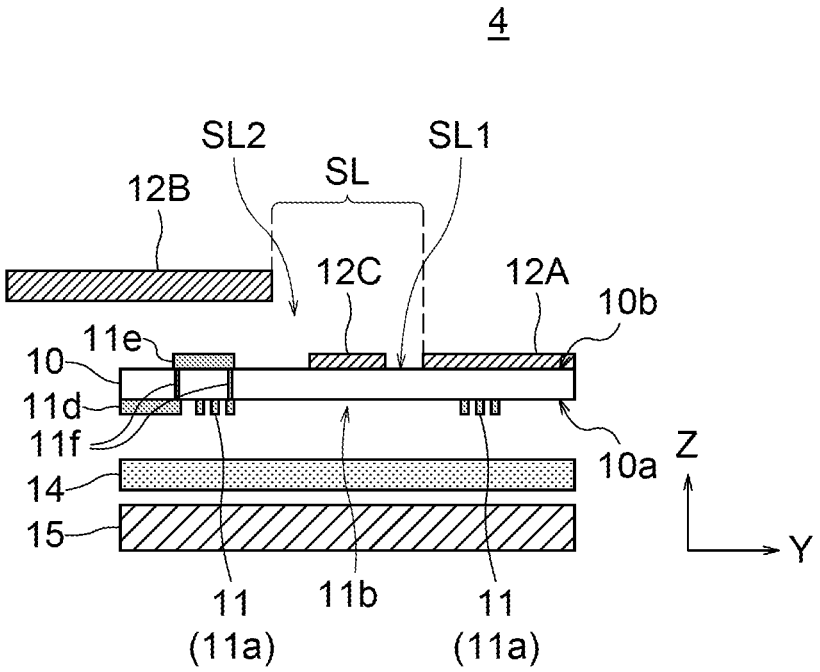
FIG. 9 is a cross-sectional view illustrating the configuration of the antenna device according to the fourth embodiment of the present invention.

FIGS. 8 and 9 are views each illustrating a configuration of the antenna device according to a fourth embodiment of the present invention. FIG. 8 is a plan view, and FIG. 9 is a cross-sectional view.

As illustrated in FIGS. 8 and 9, an antenna device of the fourth embodiment is characterized in that a center metallic layer 12C is provided at a center portion of the inner diameter pattern 11*b* of the antenna coil in a planar view. The center metallic layer 12C has an elongated rectangular pattern extending in parallel to the slit SL and is sandwiched between the first and second metallic layers 12A and 12B. As a result, the slit SL is divided into first and second slits SL1 and SL2. The inner diameter portion 11*b* of the antenna coil 11 overlaps with the two slits SL1 and SL2 in a planar view. Other configurations are the same as those of the first embodiment.

Although not especially limited, the two slits SL1 and SL2 preferably have the same width. A width of the center metallic layer 12C in a Y-direction is preferably larger than a width of each of the slits SL1 and SL2; however, when being excessively larger, the width of each of the slits SL1 and SL2 becomes excessively small, so that the width of the center metallic layer 12C needs to be set to an appropriate size. A width of the slit SL before division needs to be smaller than the width of the inner diameter pattern 11*b* of the antenna coil 11.

The antenna device 4 according to the present embodiment can provide equivalent or greater effect than that obtained in the first embodiment. That is, a combination of the first and second metallic layers 12A and 12B and the center metallic layer 120 makes the magnetic flux of the antenna coil 11 widely circulate, thereby increasing a communication distance of the antenna device. The present embodiment is particularly effective for a case where the metallic body 15 is provided at a position more distant from the antenna coil 11. That is, when the center metallic layer 12C is provided to divide the slit SL into the two slits SL1 and SL2 in a configuration where the metallic body 15 positioned at a side opposite to the antenna coil 11 with respect to the magnetic sheet 14 is comparatively distant from the antenna coil 11, it is possible to reliably increase a communication distance as compared with a case where the center metallic layer 12C is not provided.

Figure 10:
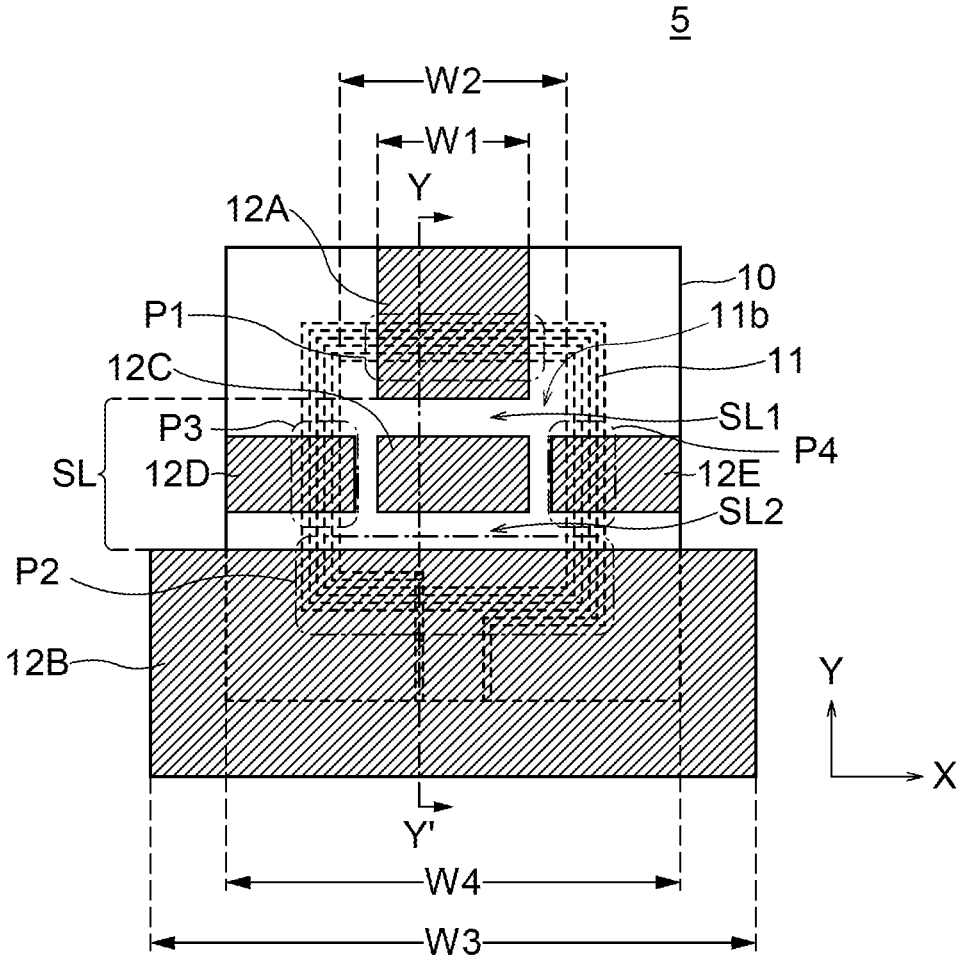
FIG. 10 is a plan view illustrating a configuration of an antenna device according to a fifth embodiment of the present invention.

FIG. 10 is a plan view illustrating a configuration of the antenna device according to a fifth embodiment of the present invention.

As illustrated in FIG. 10, an antenna device 5 of the fifth embodiment is characterized in that third and fourth metallic layers 120 and 12E are further formed, together with the antenna coil 11, the first metallic layer 12A, and the center metallic layer 12C, on the substrate 10. Other configurations are the same as those of the fourth embodiment.

In the present embodiment, the third and fourth metallic layers 12D and 12E are provided at one end and the other end of the substrate 10 in the X-direction, respectively. The third and fourth metallic layers 12D and 12E are disposed on both sides of the center of the inner diameter portion 11*b* of the antenna coil 11 in a planar view. The third metallic layer 12D overlaps with a third part P3 of the antenna coil 11 different from the first and second parts P1 and P2 in a planar view, and the fourth metallic layer 12E overlaps with a fourth part P4 of the antenna coil 11 different from the first to third parts P1 to P3 in a planar view.

According to the present embodiment, it is possible to further strengthen the magnetic flux of the antenna coil 11 in addition to the effects obtained by the fourth embodiment, thereby further improving antenna characteristics.

Figure 11A:
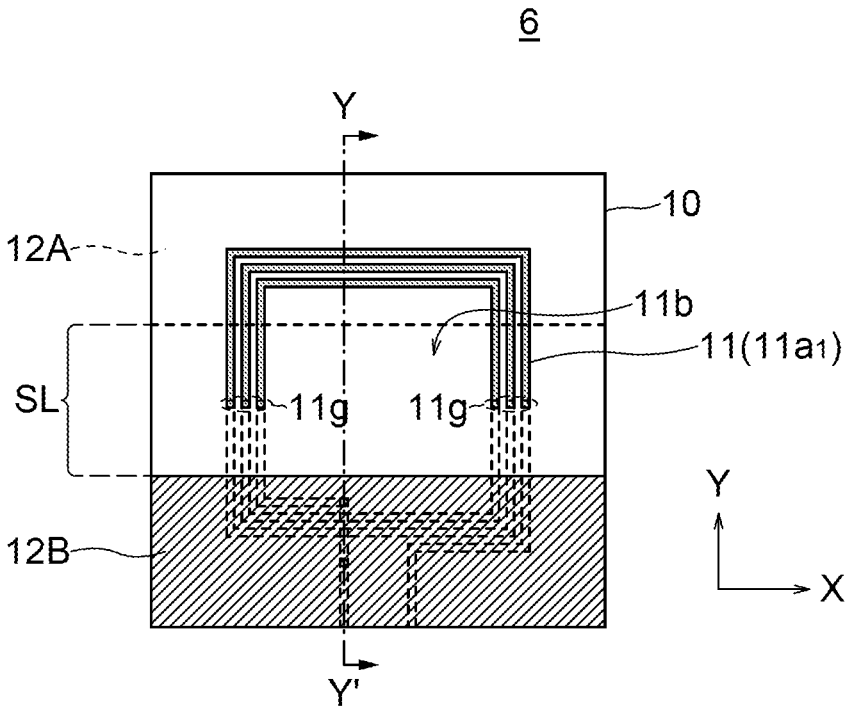
FIG. 11A is a plan view illustrating a configuration of an antenna device according to a sixth embodiment of the present invention.
Figure 11B:
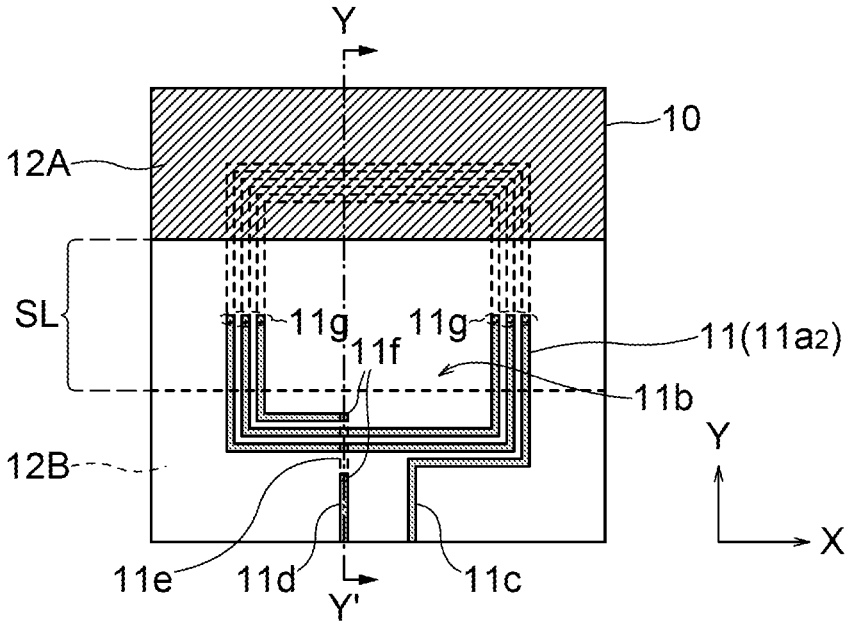
FIG. 11B is a transparent view of the antenna coil when viewed from the same direction as FIG. 11A.
Figure 12:
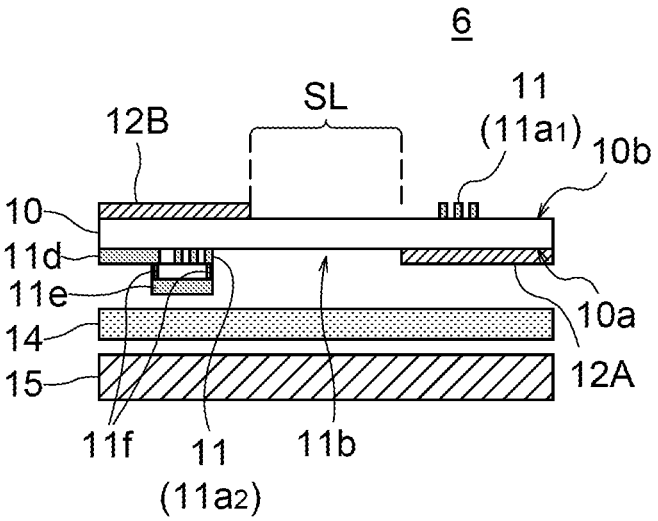
FIG. 12 is a cross-sectional view of the antenna device taken along a line Y-Y' of FIG. 11A and FIG. 11B.

FIGS. 11A and 11B are plan views each illustrating a configuration of the antenna device according to a sixth embodiment of the present invention. FIG. 11B is a transparent view of FIG. 11A as viewed in the same direction as that in FIG. 11A. FIG. 12 is a cross-sectional view taken along a line Y-Y' of FIGS. 11A and 11B.

As illustrated in FIGS. 11A and 11B and FIG. 12, in an antenna device 6 of the six embodiment, one half $\mathbf{11}a_2$ of the antenna coil 11 is formed on the one main surface (lower surface) 10*a* of the substrate 10, and the remaining half $\mathbf{11}a_1$ is formed on the other main surface (upper surface) of the substrate 10. The one half 11$a_1$ and the remaining half 11$a_2$ are connected to each other through through-hole conductors 11*g* penetrating the substrate 10 to constitute a single continuous spiral pattern. Each of end portions of a plurality of half loop patterns constituting the one half of the antenna coil 11 are connected to each of end portions of a plurality of half loop patterns constituting the remaining half 11$a_2$ of the antenna coil 11 through the through-hole conductors 11*g*.

The first metallic layer 12A is formed on the one main surface (lower surface) 10*a* of the substrate 10, and the second metallic layer 12B is formed on the other main surface (upper surface) 10*b* of the substrate 10. The first metallic layer 12A overlaps with the one half 11$a_1$ of the antenna coil 11, and the second metallic layer 12B overlaps with the remaining half 11$a_2$ of the antenna coil 11.

As described above, according to the antenna device 6 of the present embodiment, the same effects as those in the first embodiment can be obtained. That is, according to the antenna device 6, the first and second metallic layers 12A and 12B makes the loop of the magnetic flux of the antenna coil 11 widely circulate, thereby increasing a communication distance of the antenna. Particularly, the first and second metallic layers 12A and 12B are formed directly on the substrate surface, i.e., no adhesive layer is interposed between the substrate 10 and each of the first and second metallic layers 12A and 12B, so that it is possible to bring the antenna coil 11 and the first and second metallic layers 12A and 12B close to each other, thereby strengthening magnetic coupling between them, which results in an increase in a communication distance.

Figure 13A:
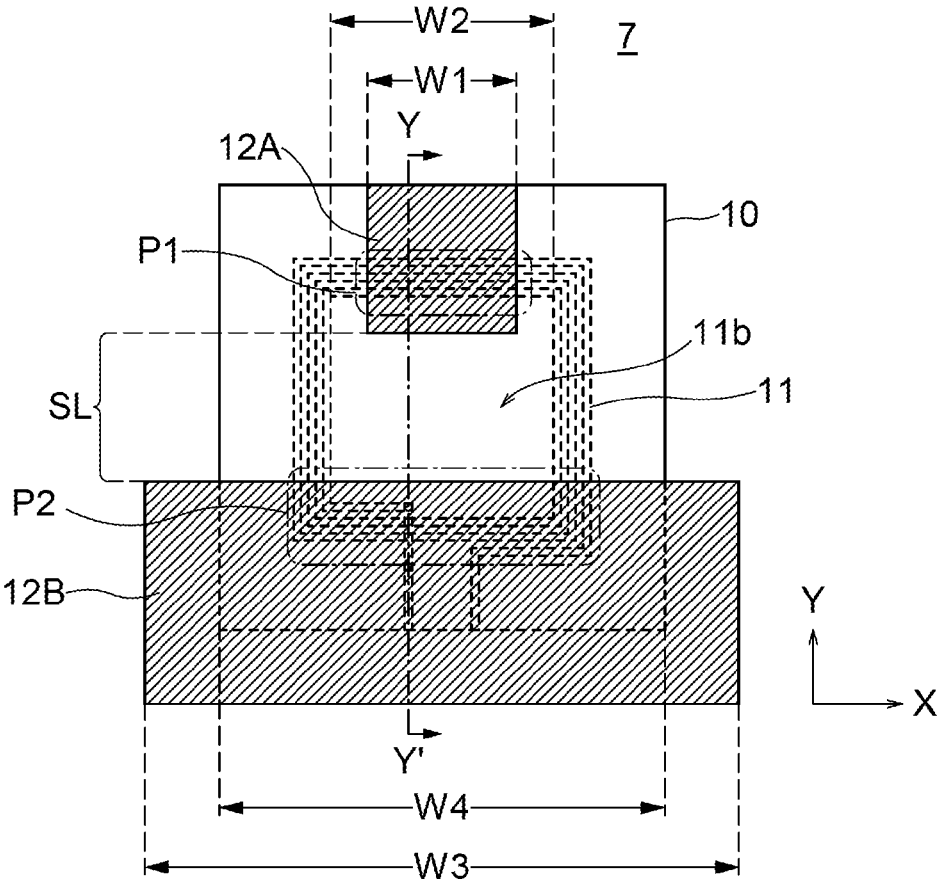
FIG. 13A is a plan view illustrating a configuration of an antenna device according to a seventh embodiment of the present invention.
Figure 13B:
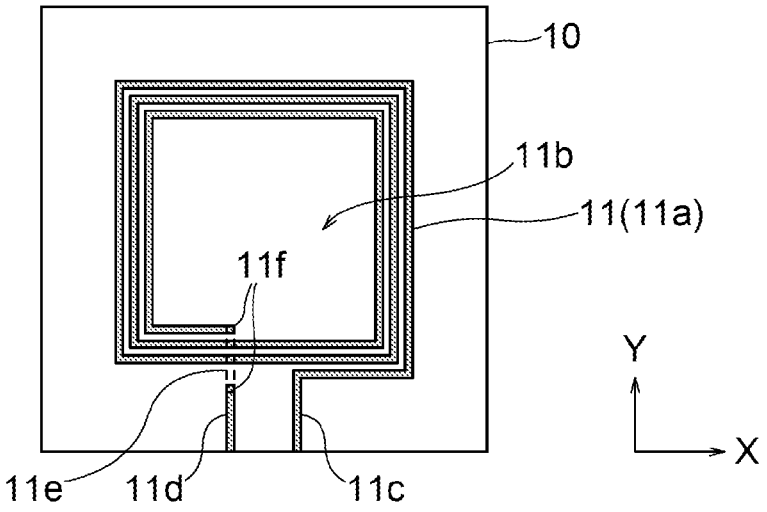
FIG. 13B is a transparent view of the antenna coil when viewed from the same direction as FIG. 13A.
Figure 14:
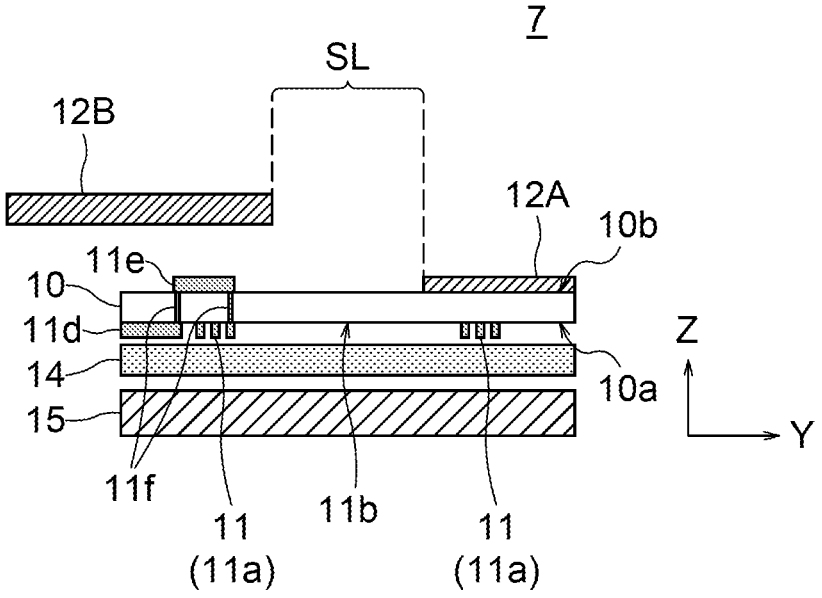
FIG. 14 is a cross-sectional view of the antenna device taken along a line Y-Y' of FIG. 13A.

FIGS. 13A and 13B are plan views each illustrating a configuration of an antenna device according to a seventh embodiment of the present invention. FIG. 13B is a view transparently illustrating the antenna coil when viewed from the same direction as FIG. 13A. FIG. 14 is a cross-sectional view of the antenna device taken along a line Y-Y' of FIG. 13A.

As illustrated in FIGS. 13A and 13B and FIG. 14, an antenna device 7 includes a substrate 10, a spiral antenna coil 11 formed on the substrate 10, first and second metallic layers 12A and 12B provided so as to overlap with the antenna coil 11 in a planar view, and a magnetic sheet 14 provided on a side opposite to the first and second metallic layers 12A and 12B with respect to the antenna coil 11.

The substrate 10 is, e.g., a flexible substrate made of PET resin and has a planar size of 40 mm×50 mm and a thickness of about 30 μm. The antenna coil 11 has a substantially rectangular spiral pattern 11*a* and is formed mainly on one main surface 10*a* (lower surface) of the substrate 10. The antenna coil 11 may be formed by plating or by etching (patterning) of a metallic layer previously formed on the entire surface of the substrate 10.

Both ends of the spiral pattern 11*a* of the antenna coil 11 are led to an edge of the substrate 10 by lead sections 11*c* and 11*d*. Particularly, an inner peripheral end of the spiral pattern 11*a* is led outside the loop through a bridge section 11*e* crossing the loop of the spiral and through-hole conductors 11*f* penetrating the substrate 10. The both ends of the antenna coil 11 are connected to, e.g., a main circuit substrate. The connection method is not especially limited. For example, the lead sections 11*c* and 11*d* may be extended together with the substrate 10 made of a flexible material so as to be connected to the main circuit substrate. Alternatively, a power feed pin may be used for the connection.

In the present embodiment, the bridge section 11*e* is formed on the other main surface 10*b* of the substrate 10. One end and the other end of the bridge section 11*e* are connected, respectively, to the inner peripheral end of the spiral pattern 11*a* and one end of the lead section 11*d* through the through-hole conductors 11*f* and 11*f*. The antenna coil 11 is formed by only patterns formed directly on the one and the other main surfaces 10*a* and 10*b* of the substrate 10, so that it is not necessary to laminate additional metallic layer for formation of the bridge section 11*e*, thus facilitating formation of the bridge section 11*e*. Particularly, since the second metallic layer 12B is not formed on the substrate 10, the bridge section 11*e* can be provided at a position overlapping with the second metallic layer 12B in a planar view, thus providing easy layout of the bridge section 11*e*.

In the present embodiment, the first metallic layer 12A has a so-called solid pattern and formed on the other main surface 10*b* (upper surface) of the substrate 10. The first metallic layer 12A may be formed by plating or by etching of a metallic layer previously formed on the entire surface of the substrate 10. When the plating is adopted, the first metallic layer 12A can be formed simultaneously with formation of the antenna coil 11. When the etching of the metallic layer is adopted, the first metallic layer 12A having a thickness different from a thickness of the antenna coil 11 can be formed. In either case, the first metallic layer 12A is not bonded to the substrate surface, and thus no adhesive (adhesive layer) is interposed, so that it is possible to bring the first metallic layer 12A close to the antenna coil 11, thereby increasing a communication distance.

The second metallic layer 12B is provided above the other main surface 10*b* of the substrate 10 so as to be opposite to the other main surface 10*b*. The second metallic layer 12B is preferably a member that constitutes a housing of a mobile electronic apparatus, such as a smartphone, in which the antenna device 7 is housed. The second metallic layer 12B may be formed on a support substrate which is different from the housing.

A metallic body 15 is provided at a position more distant than the magnetic sheet 14 from the antenna coil 11. The metallic body 15 is, e.g., a battery case of a mobile electronic device such as a smartphone in which the antenna device 7 is mounted. By interposing the magnetic sheet 14 between the antenna coil 11 and the metallic body 15, it is possible to reduce influence that the metallic body 15 exerts on the antenna coil 11, thereby increasing inductance, which can improve antenna characteristics.

In the present embodiment, the antenna coil 11 is formed by a combination of a first pattern (including the spiral pattern 11*a* and lead sections 11*c* and 11*d*) formed on the one main surface 10*a* of the substrate and a second pattern (including the bridge section 11*e*) formed on the other main surface 10*b*, and the bridge section 11*e* is formed so as to overlap with the second metallic layer 12B in a planar view. With this configuration, the antenna coil 11 and the first and second metallic layers 12A and 12B can be effectively laid out.

The first metallic layer 12A is provided on one end side in the Y-direction (first width direction) of the substrate 10, and the second metallic layer 12B is provided on the other end side in the Y-direction of the substrate 10. The first and second metallic layers 12A and 12B are disposed on both sides of the center of the inner diameter pattern 11*b* of the antenna coil 11 in a planar view.

The slit SL having a constant width is provided between the first and second metallic layers 12A and 12B, and the first and second metallic layers 12A and 12B are electrically isolated by the slit SL. The width of the slit SL is preferably smaller than the width of the inner diameter pattern 11*b* of the antenna coil 11 in the same direction. The slit SL is provided at the center of the substrate 10 in the width direction thereof and in the inner diameter pattern 11*b* of the antenna coil 11. That is, the antenna coil 11 is laid out such that the inner diameter pattern 11*b* thereof overlaps with the slit SL in a planar view. Sections of the antenna coil 11 that extend parallel to the slit SL preferably overlap with the first and second metallic layers 12A or 12B in a planar view, respectively.

In the present embodiment, the width W1 of the first metallic layer 12A in the X-direction (second direction) is smaller than the width W4 of the substrate 10 in the X-direction and is, particularly, set to equal to or less than the width W2 of the inner diameter pattern 11*b* of the antenna coil 11 in the X-direction. Thus, the planar size of the first metallic layer 12A is smaller than that of the second metallic layer 12B.

The first metallic layer 12A overlaps with the first part P1 of the antenna coil 11 in a planar view. The second metallic layer 12B overlaps with the second part P2 of the antenna coil 11 that is opposed to the first part P1 across the inner diameter portion 11*b* of the antenna coil 11 in a planar view. The area of the first part P1 of the antenna coil 11 covered by the first metallic layer 12A is smaller than the area of the second part P2 covered by the second metallic layer 12B.

In order to increase a communication distance by increasing a loop size of the magnetic flux, it is preferable to increase the planar size of the first and second metallic layers 12A and 12B as much as possible. However, when the first metallic layer 12A is formed using a pattern on the substrate 10, the planar size of the first metallic layer 12A cannot be increased unless the substrate size is increased. When the planer size of the first metallic layer 12A is tried to be increased with a limited substrate size, the antenna coil 11 is widely covered by the first metallic layer 12A to block passage of the magnetic flux, so that antenna characteristics are not necessarily improved. Thus, the width of the first metallic layer 12A to be formed on the substrate 10 is made small to reduce the planar size of the first metallic layer 12A so as to allow the magnetic flux to easily pass through the inner diameter portion 11*b* of the antenna coil 11, whereby a loss of the magnetic flux is reduced to increase a communication distance.

In conventional antenna devices, in which the planar size of both the first and second metallic layers 12A and 12B is large, a large floating capacitance is generated between the antenna coil 11 and each of the first and second metallic layers 12A and 12B, making it difficult to achieve matching at a target frequency (e.g., 13.56 MHz) due to addition of a capacitance in frequency matching. However, when the planar size of the first metallic layer 12A is reduced, it is possible to reduce the floating capacitance between the antenna coil 11 and the first metallic layer 12A, thereby facilitating antenna frequency matching.

On the other hand, the width W3 of the second metallic layer 12B in the X-direction is larger than the width W4 of the substrate 10 in the X-direction. By making use of the size of the second metallic layer 12B, the loop size of the magnetic flux can be increased, thereby contributing to an increase in a communication distance.

Figure 15:
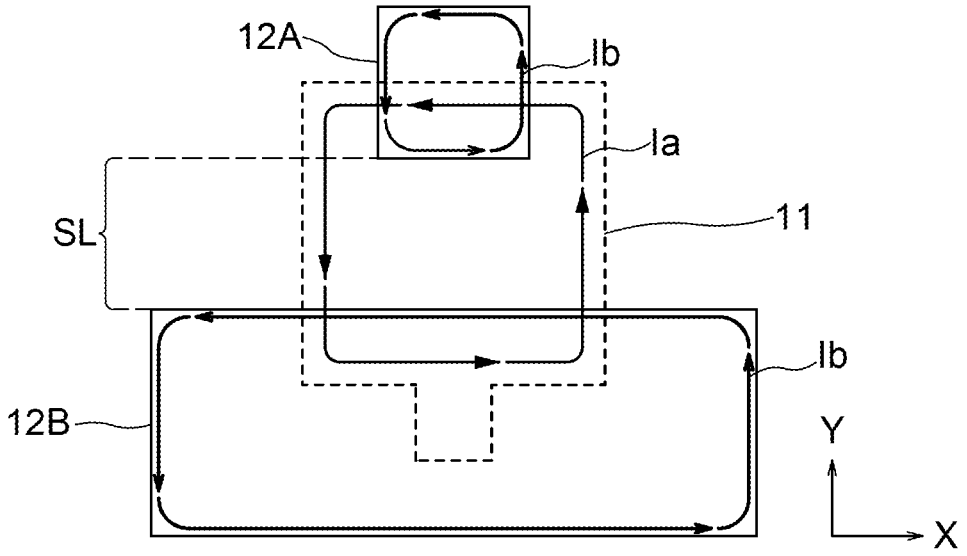
FIG. 15 is a plan view for explaining an action of the first and second metallic layers to the antenna coil.
Figure 16:
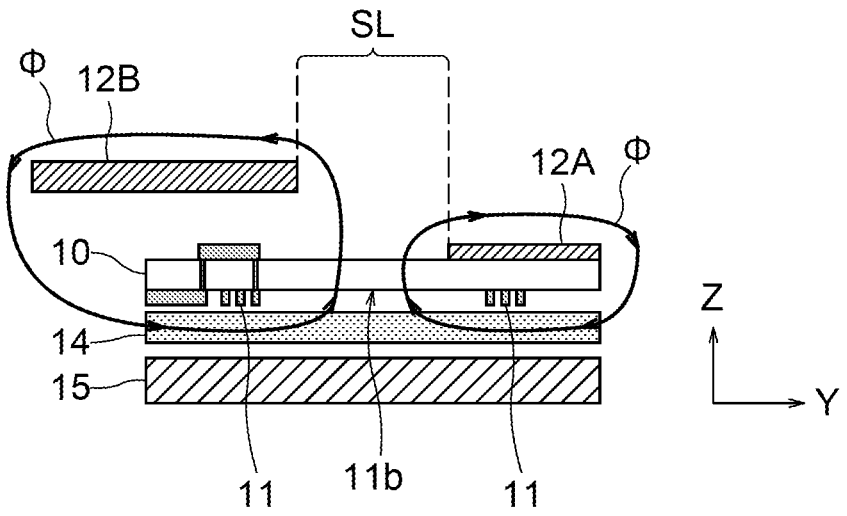
FIG. 16 is a cross-sectional view for explaining an action of the first and second metallic layers to the antenna coil.

FIGS. 15 and 16 are views for explaining an action of the first and second metallic layers 12A and 12B to the antenna coil 11. FIG. 15 is a plan view and FIG. 16 is a cross-sectional view.

As illustrated in FIGS. 15 and 16, when a counterclockwise current Ia flows in the antenna coil 11, the magnetic flux ϕ to penetrate the inner diameter portion 11*b* of the antenna coil 11 is generated. This magnetic flux ϕ passes through the slit SL disposed between the first and second metallic layers 12A and 12B and interlinks with the first and second metallic layers 12A and 12B. On the other hand, current generated by a magnetic flux in a direction that cancels the magnetic flux ϕ flows in the first and second metallic layers 12A and 12B. This current becomes the eddy current Ib by edge effect and flows along outer peripheries of the first and second metallic layers 12A and 12B. The eddy current Ib flows in the counterclockwise direction like the current Ia flowing in the antenna coil 11.

The magnetic flux ϕ that has passed through the slit SL tends to go by a roundabout path with the slit SL disposed between the first and second metallic layers 12A and 12B put inside and an outer edge of each of the first and second metallic layers 12A and 12B put outside. As a result, the magnetic flux ϕ interlinks with an antenna coil of a reader/writer while depicting a relatively large loop, with the result that the antenna device 7 is magnetically coupled to an antenna of an apparatus at a communication partner side. Particularly, since a planar size of an outer periphery of the entire metallic layer including the first and second metallic layers 12A and 12B and the slit SL is larger than a planar size of the antenna coil 11, a large loop magnetic field can be generated. Further, the magnetic sheet 14 is provided on a side opposite to the first and second metallic layers 12A and 12B with respect to the antenna coil 11, so that it is possible to increase inductance while ensuring magnetic path of the magnetic flux ϕ, thereby improving antenna characteristics.

As described above, according to the antenna device 7 of the present embodiment, the first and second metallic layers 12A and 12B can concentrate the magnetic flux ϕ on the inner diameter portion 11*b* of the antenna coil 11, thereby increasing a communication distance. Particularly, the area of the second metallic layer 12B provided separately from the substrate 10 is relatively large, so that it is possible to widely circulate the loop of the magnetic flux ϕ, thereby increasing a communication distance of the antenna device 7. Further, the area of the first metallic layer 12A formed on the substrate 10 is relatively small, so that it is possible to reduce a loss of the magnetic flux passing through the inner diameter portion 11*b* of the antenna coil 11, thereby increasing a communication distance.

It is apparent that the present invention is not limited to the above embodiments, but may be modified and changed without departing from the scope and spirit of the invention.

For example, in the above first embodiment, the bridge section 11*e* of the antenna coil 11 is provided on the one main surface 10*a* of the substrate 10 so as to overlap with the spiral pattern. Alternatively, however, the bridge section 11*e* may be provided on the other main surface 10*b* side of the substrate 10 at a position avoiding the formation area of the first and second metallic layers 12A and 12B, e.g., in the slit SL disposed between the first and second metallic layers 12A and 12B. The bridge section 11*e* is not a widely formed pattern, but a small pattern that crosses the spiral pattern at most, so that influence thereof on the magnetic flux ϕ passing through the inner diameter portion 11*b* of the antenna coil is limited.

Further, although the first and second metallic layers 12A and 12B are provided on both sides of the center of the inner diameter pattern 11*b* of the antenna coil 11 in a planar view in the seventh embodiment, the position of the first metallic layer 12A is not limited. Therefore, for example, the first metallic layer 12A may be provided at a position corresponding to the third metallic layer 12D or fourth metallic layer 12E illustrated in FIG. 10. That is, it is only necessary to form, as the metallic layer on the substrate 10, at least one of the first, third, and fourth metallic layers 12A, 12D, and 12E. Further, the center metallic layer 12C can arbitrarily be combined with the metallic layer on the substrate 10. Furthermore, although the first to fourth metallic layers 12A, 12B, 12D, and 12E and the center metallic layer 120 are formed on the substrate 10, they may be formed on a support substrate which is different from the substrate 10.

Further, although the antenna coil 11 is constituted by a spiral pattern with several turns in the above embodiments, the number of the turns in the loop pattern may be less than one turn. That is, the antenna coil 11 only needs to be a loop-shaped or a spiral-shaped planar coil pattern.

What is claimed is:

1. An antenna device comprising:

a substrate having first and second planes parallel with each other;

an antenna coil formed into a loop shape or a spiral shape on the first plane of the substrate;

a first metallic layer overlapping with a first part of the antenna coil in a planar view; and a second metallic layer overlapping with a second part of the antenna coil different from the first part, wherein the first and second metallic layers are disposed on both sides of a center of an inner diameter portion of the antenna coil in a planar view, respectively, a slit formed between the first and second metallic layers overlaps with the inner diameter portion of the antenna coil in a planar view, and wherein the first metallic layer is formed on the second plane of the substrate, and the second metallic layer is positioned on a third plane farther from the first plane than the second plane such that a distance between each of the first and second parts of the antenna coil formed on the first plane and the second metallic layer in a vertical direction perpendicular to the substrate is greater than a distance between each of the first and second parts of the antenna coil formed on the first plane and the first metallic layer in the vertical direction.

2. The antenna device as claimed in claim 1, wherein the second metallic layer is a member that constitutes a housing in which the antenna device is housed.

3. The antenna device as claimed in claim 2, wherein the antenna coil includes a combination of a first pattern formed on one main surface of the substrate and a second pattern formed on the other main surface of the substrate, the first metallic layer is formed on the other main surface of the substrate, the second metallic layer is provided so as to be opposed to the other main surface of the substrate, and the second pattern is provided so as to overlap with the second metallic layer in a planar view.

4. The antenna device as claimed in claim 1, further comprising:

a metallic body provided so as to overlap with the antenna coil in a planar view; and a magnetic sheet provided between the antenna coil and the metallic body.

5. The antenna device as claimed in claim 1, further comprising a center metallic layer provided in a center portion of the inner diameter portion of the antenna coil in a planar view.

6. The antenna device as claimed in claim 1, further comprising:

a third metallic layer that overlaps with a third part of the antenna coil different from the first and second parts in a planar view; and a fourth metallic layer that overlaps with a fourth part of the antenna coil different from the first to third parts in a planar view, wherein the third and fourth metallic layers are disposed on both sides of the center of the inner diameter portion of the antenna coil in a planar view, respectively.

7. An antenna device comprising:

a substrate;

an antenna coil formed into a loop shape or a spiral shape on the substrate;

a first metallic layer formed overlapping with a first part of the antenna coil in a planar view; and a second metallic layer formed overlapping with a second part of the antenna coil different from the first part in a planar view, wherein the first and second part of the antenna coil are positioned on a same plane as each other, the first and second metallic layers are positioned on different planes from each other, a planar size of the second metallic layer is larger than a planar size of the first metallic layer, and the second metallic layer is positioned farther from the antenna coil than the first metallic layer such that a distance between each of the first and second parts of the antenna coil and the second metallic layer in a vertical direction perpendicular to the substrate is greater than a distance between each of the first and second parts of the antenna coil and the first metallic layer in the vertical direction.

8. The antenna device as claimed in claim 7, wherein the first metallic layer is formed on the substrate together with the antenna coil.

9. The antenna device as claimed in claim 7, wherein the second metallic layer is a member that constitutes a housing in which the antenna device is housed.

10. The antenna device as claimed in claim 7, wherein the antenna coil includes a combination of a first pattern formed on one main surface of the substrate and a second pattern formed on the other main surface of the substrate, the first metallic layer is formed on the other main surface of the substrate, the second metallic layer is provided so as to be opposed to the other main surface of the substrate, and the second pattern is provided so as to overlap with the second metallic layer in a planar view.

11. The antenna device as claimed in claim 7, wherein the first and second metallic layers are disposed on both sides of a center of an inner diameter portion of the antenna coil in a planar view, respectively.

12. The antenna device as claimed in claim 7, further comprising a center metallic layer provided in a center portion of the inner diameter portion of the antenna coil.

13. The antenna device as claimed in claim 7, further comprising:

a third metallic layer that overlaps with a third part of the antenna coil different from the first and second parts in a planar view; and a fourth metallic layer that overlaps with a fourth part of the antenna coil different from the first to third parts in a planar view, wherein the third and fourth metallic layers are disposed on both sides of the center of the inner diameter portion of the antenna coil in a planar view, respectively.

14. The antenna device as claimed in claim 13, wherein the third and fourth metallic layers are formed on the substrate together with the antenna coil and the first metallic layer.

15. The antenna device as claimed in claim 13, wherein the third metallic layer is provided on one end side of the substrate in the second width direction of the substrate, and the fourth metallic layer is provided on the other end side of the substrate in the second width direction of the substrate.

16. A device comprising:

a substrate including a first plane having a first area, a second area, and a third area positioned between the first and second areas;

a coil pattern formed on the first plane of the substrate over the first, second, and third areas;

a first metal member covering the first area of the substrate without covering the second and third areas of the substrate, the first metal member being positioned on a second plane; and a second metal member covering the second area of the substrate without covering the first and third areas of the substrate, the second metal member being positioned on a third plane, wherein the first, second and third planes are parallel with one another, and wherein the second plane is positioned between the first and third planes.

17. The device as claimed in claim 16, wherein the second metal member is a part of a housing in which the device is housed.

18. The device as claimed in claim 16, wherein the second metal member is greater in a planar size than the first metal member.

19. The device as claimed in claim 1, wherein the first, second, and third planes are parallel with one another, and wherein the second plane is positioned between the first and third planes.

20. The device as claimed in claim 16, wherein the second plane is positioned on the substrate, and wherein the third plane is positioned outside the substrate.

* * * * *